US006543174B2

(12) United States Patent
O'Dwyer

(10) Patent No.: US 6,543,174 B2
(45) Date of Patent: Apr. 8, 2003

(54) BARREL ASSEMBLY WITH OVER-PRESSURE RELIEF

(75) Inventor: James Michael O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 0 days.

(21) Appl. No.: 10/116,463

(22) Filed: Apr. 5, 2002

(65) Prior Publication Data

US 2002/0157526 A1 Oct. 31, 2002

Related U.S. Application Data

(63) Continuation-in-part of application No. 09/445,025, filed as application No. PCT/AU98/00415 on Jun. 2, 1998.

(30) Foreign Application Priority Data

Jun. 3, 1997 (AU) ..... PO7158
Jul. 11, 2001 (AU) ..... PR6295

(51) Int. Cl.[7] ..... F41A 21/00

(52) U.S. Cl. ..... 42/76.01; 89/1.41; 89/28.05; 89/126

(58) Field of Search ..... 42/76.01; 89/1.41, 89/28.05, 28.1, 135, 126, 14.05, 27.13

(56) References Cited

U.S. PATENT DOCUMENTS 4,872,392 A * 10/1989 Powers et al. ..... 137/512.15
5,109,748 A 5/1992 Bertiller et al. ..... 89/1.2
5,171,931 A * 12/1992 Steele ..... 42/105
5,404,790 A * 4/1995 Averbukh ..... 89/193
5,883,329 A * 3/1999 O'Dwyer ..... 102/217
5,937,563 A * 8/1999 Schuetz et al. ..... 42/106

FOREIGN PATENT DOCUMENTS

| | | |
|---|---|---|
| CA | 2189904 | 5/1998 |
| WO | 98/55819 | 12/1998 |
| WO | 01/14819 | 3/2001 |

* cited by examiner

*Primary Examiner*—J. Woodrow Eldred
(74) *Attorney, Agent, or Firm*—Oblon, Spivak, McClelland, Maier & Neustadt, P.C.

(57) ABSTRACT

A barrel assembly (70) comprising a plurality of projectiles (75) axially disposed within a barrel (71) and associated with discrete selectively ignitable propellant charges (74) for propelling the projectiles from the barrel. The essence of the invention is the provision of a pressure relief valve, for example comprised by a port (73) and plug (76), associated with a chamber in which a propellant charge (74) is ignited. The pressure relief valve (73, 76) is designed to prevent catastrophic failure of the barrel (71) by exhausting via a chamber (72) in the event that the barrel is blocked by a projectile and detonation of one or more propellant charges (74) occurs.

20 Claims, 9 Drawing Sheets

BARREL ASSEMBLY WITH OVER-PRESSURE RELIEF

CROSS REFERENCE TO RELATED APPLICATIONS

This application is a continuation-in-part of application Ser. No. 09/445,025 filed as application Ser. No. PCT/AU98/00415 on Jun. 2, 1998.

TECHNICAL FIELD

The invention relates to firearms and weapons for firing projectiles. In particular, the present invention relates to barrel assemblies for guns such as firearms and larger calibre weapons.

This invention has particular, but not exclusive, application to handguns including shotgun type firearms and to other weapons which utilize barrel assemblies such as described in the inventor's earlier International Patent Applications Nos. PCT/AU94/00124 and PCT/AU96/00459.

Such barrels each have a plurality of projectiles stacked axially within the barrel together with discrete selectively ignitable propellant charges for propelling the projectiles sequentially through the muzzle of the barrel and the sealing engagement between projectiles and barrel being such as to prevent rearward travel of the ignited propellant charge to trailing propellant charges. These barrels will be referred to hereinafter as of the type described.

BACKGROUND ART

This invention aims to alleviate perceived shortcomings in conventional weapons such as shotguns which fire a collection of round pellet like shot randomly oriented in the cartridge, which when fired exit from a relatively large bore barrel in a random orientation and at a relatively slow muzzle velocity.

The shot immediately disperses to cover a relatively large target zone. This effect is useful but the effective range of the shot is very short. Shotguns also require reloading between shots and this reduces their effectiveness.

Handguns such as pistols also have significant limitations for many reasons including the limited number of shots which may be contained in the weapon and the relatively slow rate of fire available. However they are very portable and concealable and this makes them very useful.

In the earlier filed International Patent Application No. PCT/AU96/00459 there is described a wedging action between the head part and the anvil part that effects a seal between a projectile and the bore of the barrel behind the propellant charge being fired. This seal ensures minimum loss of propellant past the projectile and maintains a seal between the next projectile and the barrel so that the ignited propellant does not pass the next remaining projectile and cause ignition of the propellant charge therebehind.

While no jamming of rounds has been experienced to date it is considered that this possibility needs to be addressed, especially if high barrel pressures in the order of 60,000 psi plus are to be utilised. The present systems are intended to operate with a maximum internal pressure in the order of 40,000 psi chamber pressure.

We have now found a barrel assembly that provides improved safety in that risk of catastrophic failure of the barrel assembly is reduced in the event of a "hang-fire". In the event of a round jamming or a projectile other than the leading projectile being fired there is a risk that the pressure in the barrel may increase as a result of detonated propellant charge(s) such that the barrel itself may explode.

DISCLOSURE OF INVENTION

In one aspect, the present invention provides a barrel assembly comprising a plurality of projectiles axially disposed within a barrel and associated with discrete selectively ignitable propellant charges for propelling the projectiles from the barrel wherein said barrel includes at least one pressure relief valve associated with a chamber in which a propellant charge is ignited.

In a preferred configuration the pressure relief valve vents into a bypass passage that exhausts in the direction of fire of the barrel assembly. In such a configuration there may be an exhaust that is parallel to the barrel assembly. Alternatively, the exhaust may be coaxial with and of larger diameter to the barrel. The exhaust may extend the length of the barrel, may extend beyond the muzzle of the barrel or may terminate prior to the muzzle of the barrel.

The pressure relief valve may be in the form of a plug or bung fixed into the barrel such that once the barrel pressure reaches a selected limit the plug or bung is ejected from the aperture into which it is fixed. Alternatively, the pressure relief valve may be in the form of a rupturable section of the barrel that is formed from a material that is selected to fail once the barrel pressure reaches a selected limit.

Preferably the barrel assembly includes a shielded cover for retaining the any ejected component from the pressure relief valve or at least preventing such a component from becoming a safety issue. For instance an ejected plug or bung could become a lethal projectile if ejected in an unrestrained manner. Similarly, any debris from a rupturable section of barrel may become a dangerous projectile that may be ejected laterally from the barrel. As such, in a weapon system, laterally fired projectiles would be unexpected and be a considerable risk. The shielded cover may be in the form of an armour-plated cover, a pneumatic chamber, a damped receptacle such as an oil filled reservoir.

A pressure relief valve may be positioned in the barrel adjacent each chamber in which a propellant charge is detonated. Alternatively, depending on the structural properties of the barrel, the risk of catastrophic failure may be significant only if a number of propellant charges are detonated in the confined barrel. In such configurations the pressure relief valves may be positioned along barrel and spaced so as to associate with every second, third or more propellant charges.

The present invention has particular application to barrel assemblies of the type described in International Patent Application Nos. PCT/AU94/00124 and PCT/AU96/00459. Such barrel assemblies include a barrel; a plurality of projectiles axially disposed within the barrel for operative sealing engagement with the bore of the barrel, and discrete propellant charges for propelling respective projectiles sequentially through the muzzle of the barrel.

The projectiles may be round, conventionally shaped or dart-like and the fins thereof may be offset to generate a stabilising spin as the dart is propelled from a barrel that may be a smooth-bored barrel.

The projectile charge may be in the form of a solid block and assist in operatively spacing the projectiles in the barrel. Alternatively, the propellant charge may be encased in metal or other rigid case which may include an embedded primer having external contact means adapted for contacting an pre-positioned electrical contact associated with the barrel. For example the primer could be provided with a sprung contact which may be retracted to enable insertion of the cased charge into the barrel and to spring out into a barrel aperture upon alignment with that aperture for operative contact with its mating barrel contact. If desired the outer case may be consumable or may chemically assist the propellant burn. Furthermore an assembly of stacked and bonded or separate cased charges and projectiles may be provided for reloading a barrel.

Each projectile may include a projectile head and extension means for at least partly defining a propellant space. The extension means may include a spacer assembly that extends rearwardly from the projectile head and abuts an adjacent projectile assembly. Such an extension means may assist the detent in the barrel in supporting the projectiles in position within the barrel when a leading charge is fired.

A spacer assembly may extend through the propellant space and the projectile head whereby compressive loads are transmitted directly through abutting adjacent spacer assemblies. In such configurations, the spacer assembly may add support to the detent and extension means. The extension means may be a thin cylindrical rear portion of the projectile head. Furthermore the extension means may form an operative sealing contact with the bore of the barrel to prevent burn leakage past the projectile head.

The spacer assembly may include a rigid collar that extends outwardly to engage a thin cylindrical rear portion of a malleable projectile head in operative sealing contact with the bore of the barrel. Thus axially compressive loads are transmitted directly between spacer assemblies thereby avoiding deformation of the malleable projectile head.

Complementary wedging surfaces may be disposed on the spacer assembly and projectile head respectively whereby the projectile head is urged into engagement with the bore of the barrel in response to relative axial compression between the spacer means and the projectile head. In such arrangement the projectile head and spacer assembly may be loaded into the barrel and there after an axial displacement is caused to ensure good sealing between the projectile head and barrel. Suitably the extension means may be urged into engagement with the bore of the barrel.

The projectile head may define a tapered aperture at its trailing end into which is received a complementary tapered spigot disposed on the leading end of the spacer assembly. Relative axial movement between the projectile head and the complementary tapered spigot causes a radially expanding force to be applied to the projectile head.

The barrel may be non-metallic and the bore of the barrel may include recesses that may fully or partly accommodate the ignition means. In this configuration the barrel houses electrical conductors which facilitate electrical communication between the control means and ignition means. This configuration may be utilised for disposable barrel assemblies that have a limited firing life. The ignition means and control wire or wires therefor can be integrally manufactured with the barrel.

A barrel assembly may alternatively include ignition apertures in the barrel and the ignition means are disposed outside the barrel and adjacent the apertures. A non-metallic outer barrel may surround the barrel. The non-metallic outer barrel may include recesses adapted to accommodate the ignition means. The outer barrel may also house electrical conductors that facilitate electrical communication between the control means and ignition means. The outer barrel may be formed as a laminated plastic barrel that may include a printed circuit laminate for the ignition means.

The rear end of the projectile may include a skirt about an inwardly reducing recess such as a conical recess or a part-spherical recess or the like into which the propellant charge portion extends and about which rearward movement of the projectile will result in radial expansion of the projectile skirt. This rearward movement may occur by way of compression resulting from a rearward wedging movement of the projectile along the leading portion of the propellant charge it may occur as a result of metal flow from the relatively massive leading part of the projectile to its less massive skirt portion.

Alternatively the projectile may be provided with a rearwardly divergent peripheral sealing flange or collar which is deflected outwardly into sealing engagement with the bore upon rearward movement of the projectile. Furthermore the sealing may be effected by inserting the projectiles into a heated barrel which shrinks onto respective sealing portions of the projectiles. The projectile may comprise a relatively hard mandrel portion that cooperates with a deformable annular portion. The deformable annular portion may be moulded about the mandrel to form a unitary projectile which relies on metal flow between the nose of the projectile and its tail for outward expansion about the mandrel portion into sealing engagement with the bore of the barrel.

The projectile assembly may include a rearwardly expanding anvil surface supporting a sealing collar thereabout and adapted to be radially expanded into sealing engagement with the barrel bore upon forward movement of the projectile through the barrel. In such a configuration it is preferred that the propellant charge have a cylindrical leading portion which abuts the flat end face of the projectile.

The projectiles may be adapted for seating and/or location within circumferential grooves or by annular ribs in the bore or in rifling grooves in the bore and may include a metal jacket encasing at least the outer end portion of the projectile. The projectile may be provided with contractible peripheral locating rings that extend outwardly into annular grooves in the barrel and which retract into the projectile upon firing to permit its free passage through the barrel.

The electrical ignition for sequentially igniting the propellant charges of a barrel assembly may preferably include the steps of igniting the leading propellant charge by sending an ignition signal through the stacked projectiles. The ignition of the leading propellant charge may arm the next propellant charge for actuation by the next ignition signal. Suitably all propellant charges inwardly from the end of a loaded barrel are disarmed by the insertion of respective insulating fuses disposed between normally closed electrical contacts. The fuses being set to burn to enable the contacts to close upon transmission of a suitable triggering signal and each insulating fuse being open to a respective leading propellant charge for ignition thereby.

Ignition of the propellant may be achieved electrically or ignition may utilise conventional firing pin type methods such as by using a center-fire primer igniting the outermost projectile and controlled consequent ignition causing sequential ignition of the propellant charge of subsequent rounds. This may be achieved by controlled rearward leakage of combustion gases or controlled burning of fuse columns extending through the projectiles.

In another form the ignition is electronically controlled with respective propellant charges being associated with primers which are triggered by distinctive ignition signals. For example the primers in the stacked propellant charges may be sequenced for increasing pulse width ignition requirements whereby electronic controls may selectively send ignition pulses of increasing pulse widths to ignite the propellant charges sequentially in a selected time order.

Preferably however the propellant charges are ignited by a set pulse width signal and burning of the leading propellant charge arms the next propellant charge for actuation by the next emitted pulse.

A number of projectiles can be fired simultaneously, or in quick succession, or in response to repetitive manual actuation of a trigger, for example. In such arrangements the electrical signal may be carried externally of the barrel or it may be carried through the superimposed projectiles which may clip on to one another to continue the electrical circuit through the barrel, or abut in electrical contact with one another. The projectiles may carry the control circuit or they may form a circuit with the barrel.

The barrel assembly may be incorporated in a variety of ordnance. In one embodiment the barrel assembly of the present invention may be incorporated into firearm such as a pistol, rifle or other small arm. In another embodiment the barrel assembly of the present invention may be incorporated in a large calibre fixed mounted gun. The present invention also includes guns incorporating the barrel assembly described above. The guns of the present invention may also include other features and components associated with guns of the prior art, including butts, handles, sights, fixed mounts, and the like.

According to another aspect this invention resides broadly in a handgun assembly comprising

- a cluster of small bore barrels of the type described each barrel including:
  - a longitudinal arrangement of aerodynamically shaped, directional projectiles and interposed propellant charges whereby the barrel assembly has longitudinal arrays or layers of projectiles and interposed propellant charges arranged in longitudinally spaced relationship in their respective barrels, and
  - at least one pressure relief valve associated with a chamber wherein a propellant charge is detonated; and
- ignition means for simultaneously igniting the propellant charges in a respective layer of propellant charges.

According to a further aspect this invention resides broadly in a handgun assembly comprising

- a barrel assembly including a cluster of barrels of the type described;
- each barrel including:
  - a longitudinal arrangement of aerodynamically shaped, directional projectiles and interposed propellant charges whereby the barrel assembly has longitudinal arrays or layers of projectiles and interposed propellant charges, and
  - at least one pressure relief valve associated with a chamber wherein a propellant charge is detonated; and
- ignition means for simultaneously igniting the propellant charges in a respective layer of propellant charges.

The foregoing may form the entire barrel assembly of the shotgun or the barrel assembly may constitute only a portion of the shotgun's barrel assembly, such as by being a replaceable cartridge communicating with fixed barrels in the shotgun. The barrels may be parallel or may splay slightly to achieve a desired firing pattern.

Each barrel may have its own electronic ignition means. Preferably however the barrels are clustered about one or more ignition passages extending substantially parallel to the barrels and communicating therewith through longitudinally spaced arrays of transverse bleed passages so as to selectively initiate ignition of primers in the or each ignition passage spreads through the respective aligned one of the longitudinal array of transverse bleed passages and causes ignition of the respective propellant charges communicating therewith.

The barrels may also be clustered about one or more bypass passages extending substantially parallel to the barrels and communicating therewith through a valved port communicating with longitudinally spaced arrays of transverse bleed passages whereby in the event of an accidental ignition of a primer in a trailing round, the valved port will open to enable the ignited propellant charges to bleed to atmosphere through the bypass passage.

Alternatively, individual barrels may be provided with valved ports enabling each to discharge to a bypass passage in the event of a hang fire or similar accidental ignition of a trailing propellant charge. Suitably the valved port is in the form of a plugged port in which the plug will be dislodged at a preselected pressure above the normal operating pressures within the barrels.

The handgun may be in the form of a shotgun and have a large number of small bore barrels clustered about the, or each, ignition passage, but preferably a central ignition passage. The ignition passage may constitute a main barrel provided with primer initiation means for selective initiation of the propellant charges therein. The main barrel is suitably the center barrel and may have a larger bore than the others if desired.

For example, a cluster of approximately sixty-four 2 mm barrels could be provided. This provides a shotgun in which all the simultaneously fired projectiles are individually barrelled. The projectiles would be in the order of 2 mm diameter and 5 mm in length. If the leading primer in the main barrel is ignited, then all sixty-four projectiles in the leading layer will be fired.

The barrels may be rifled and the projectiles may be loaded therein in cartridges. Alternatively the barrel may be provided as a disposable barrel containing the projectiles and propellant charges stacked therein.

The cartridges could align with a single large open barrel of the shotgun but preferably the barrels of the cartridge align with correspondingly arranged small bore barrels in the shotgun. For this purpose the cartridge is provided with locating means for locating it in operative alignment with the shotgun barrels and most preferably the cartridge has a square section housing for operative location with any of its rectangular side faces entered through the loading/ejection port. This port could be a side, top or underside port.

Any number of groups of sixty-four pellets/projectiles may be fired at any electronically available rate. This provides on the one hand, a low degree of lethality in the case where say a single group of pellets is fired, or an exceedingly high degree of lethality if a number of groups are fired in rapid succession. The weapon may be operated as a shotgun machine-gun.

The primer initiation is suitably electronically controlled and may be electrical, chemical, laser, mechanical or any other available means as is appropriate.

In yet a further aspect this invention resides in a method of igniting the propellant charges for rounds in a cluster of barrels, including:

- providing an ignition passage containing a longitudinal array of primers and communicating with corresponding propellant charges in the barrels through respective longitudinally spaced arrays of bleed passages, and
- selectively and sequentially igniting the primers in the ignition passage to causes ignition of the respective propellant charges communicating therewith.

BRIEF DESCRIPTION OF THE DRAWINGS

In order that this invention may be more readily understood and put into practical effect, reference will now be made to the accompanying drawings which illustrate typical embodiments of the invention, wherein.

DESCRIPTION OF THE PREFERRED EMBODIMENTS

Figure 1:
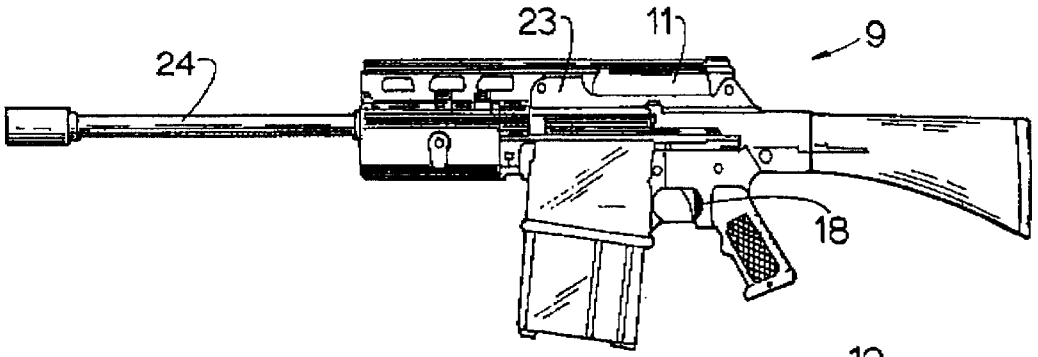
FIGS. 1 and 2 illustrate typical shotguns according to an embodiment of the invention.
Figure 2:
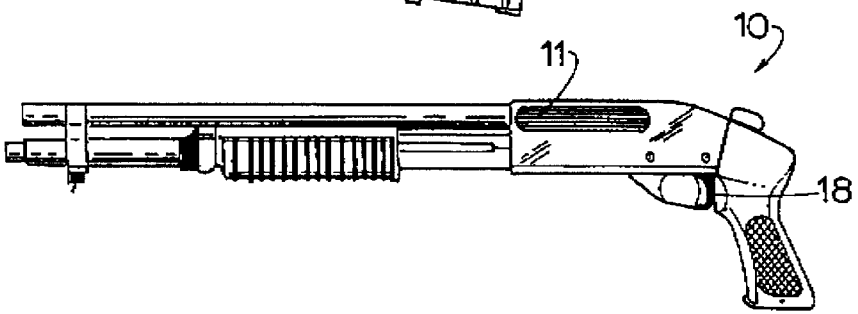

The shotguns 9 and 10 illustrated in FIGS. 1 and 2 are similar to the Smith & Wesson AS and the Remington 870 twelve gauge shotguns respectively and have similar loading and unloading features.

Figure 4:
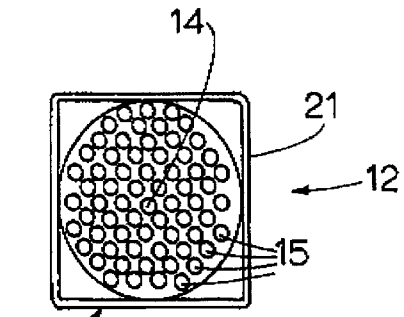
FIG. 4 is an end view of the cartridge illustrated in FIG. 2.
Figure 3:
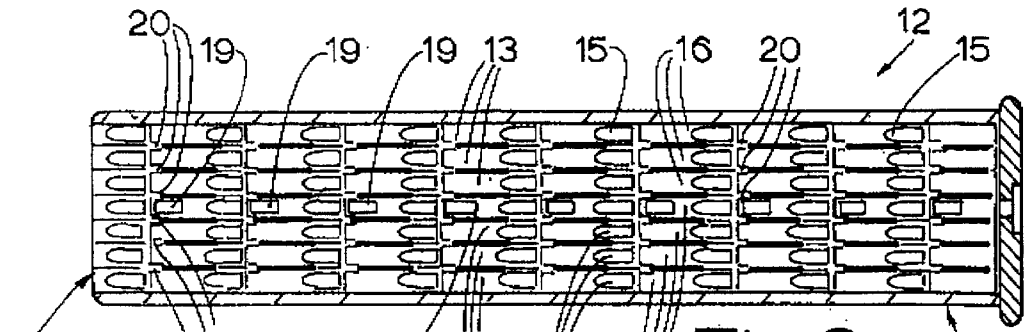
FIG. 3 is a diagrammatic sectional view of a shotgun cartridge for the shotguns illustrated in FIGS. 1 and 2.
Figure 5A:
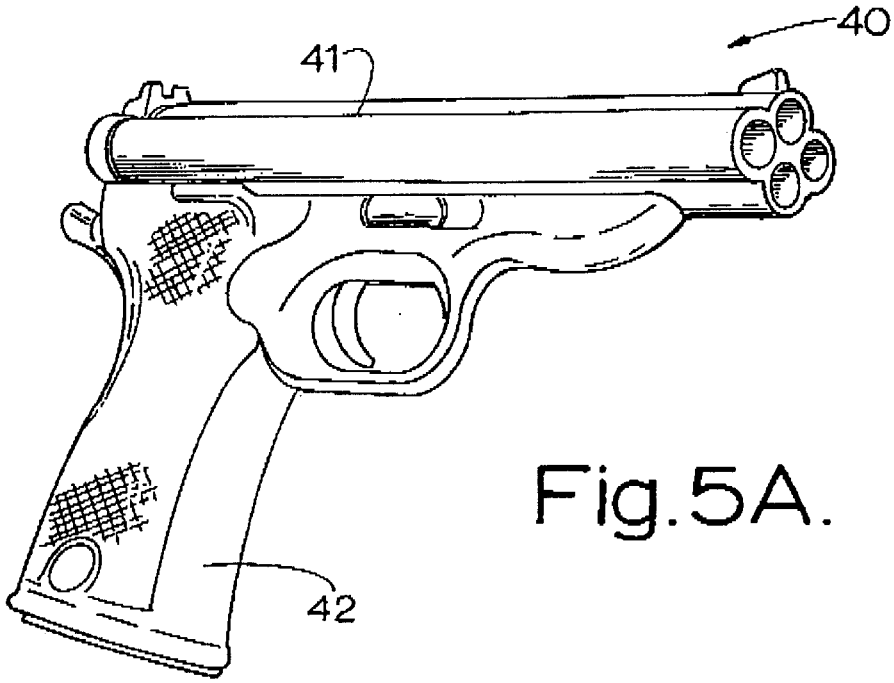
FIGS. 5A to 5D illustrate loading of one preferred form of handgun.
Figure 5B:
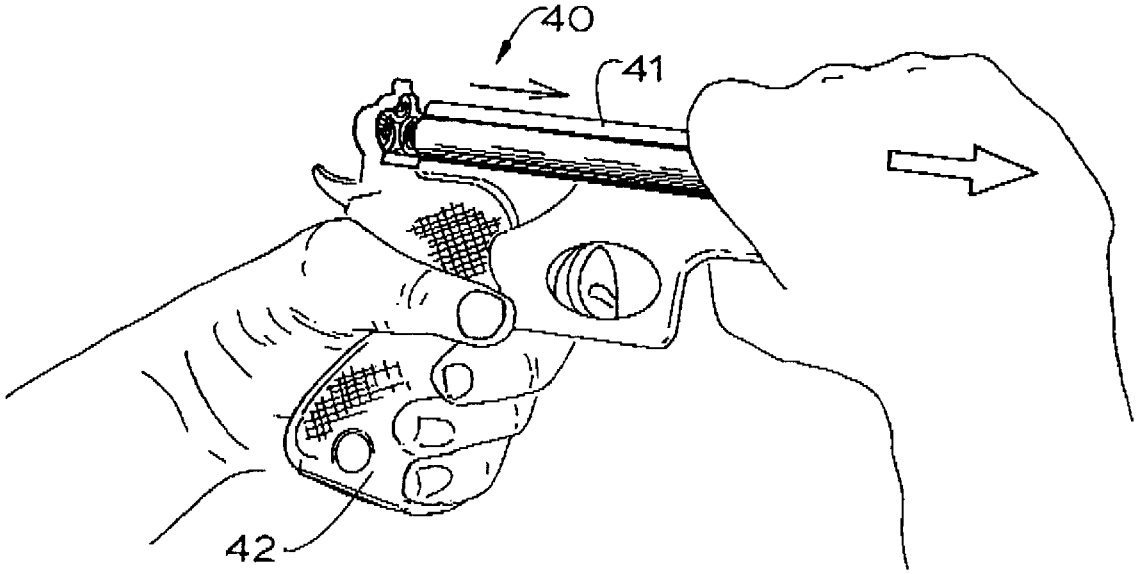
Figure 5C:
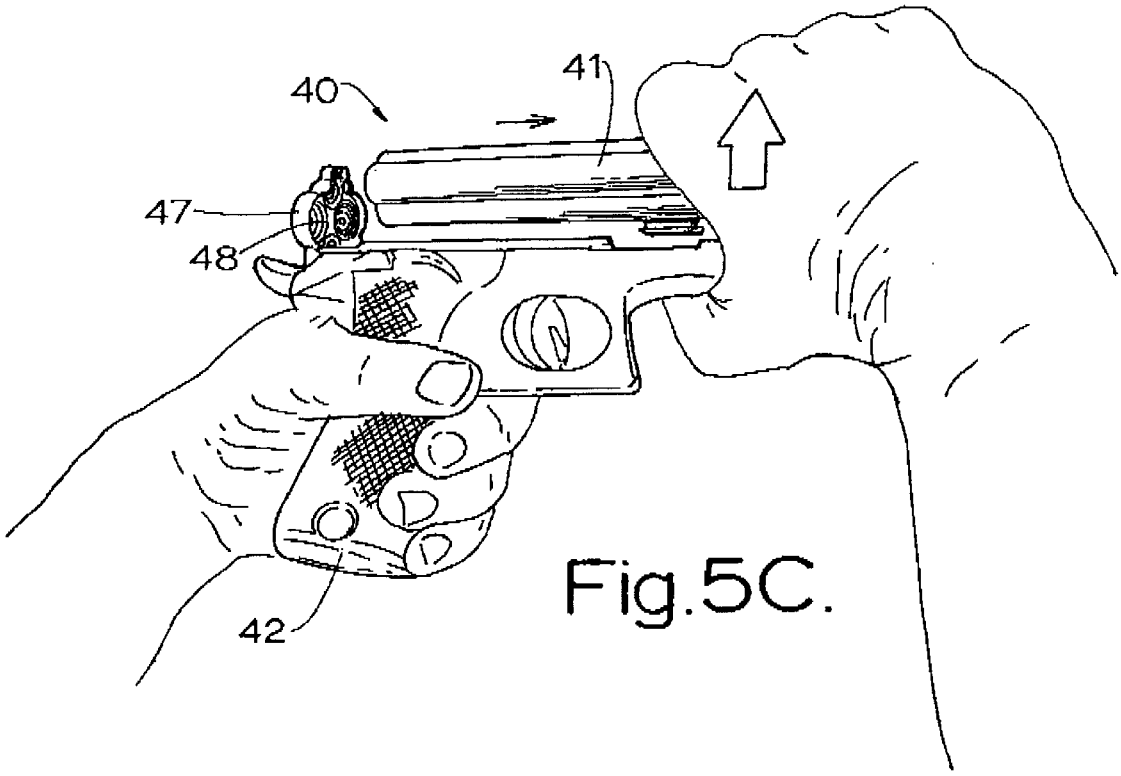
Figure 5D:
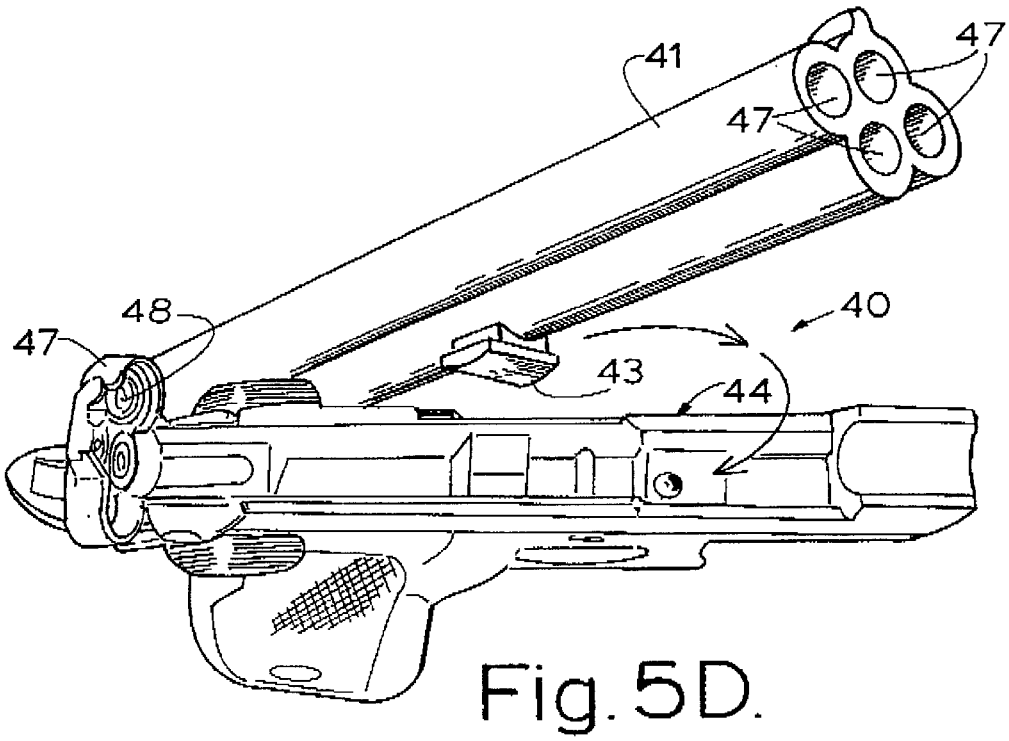

However in each case, the feed/ejection port 11 has been lengthened to accept a multi-barrel cartridge 12 as illustrated in FIGS. 3 and 4 which contains sixty (60) 2 mm bore barrels 13 arranged symmetrically about a central main barrel 14, with nine longitudinally spaced layers of streamlined directional projectiles 15 and associated propellant charges 16 therein.

The main barrel 14 is provided with electrical connections controlled from electronic control means located in the butt of the shotgun and activated by the trigger 18 in a conventional manner. The electrical connections are controlled for selective ignition of the primers 19 in the respective propellant charges 16 and an array of bleed ports 20 is provided to place the corresponding propellant charges 16 in the barrels 13 in communication with the respective propellant charges in main barrel 14.

Upon ignition of the leading propellant charge 16 in the main barrel 14, the explosion front will spread through the bleed ports 20 and ignite all the propellant charges in the corresponding layer.

The barrels 13 are clustered in a circular configuration about the main barrel 14 and are supported in a square sectioned housing 21 which may be introduced into the port feed end 22 first in any desired rotational attitude. The square housing 21 is used to positively locate the cartridge in the shotgun body 23 in alignment with the correspondingly clustered barrel assembly 24 extending from the body.

Figure 9:
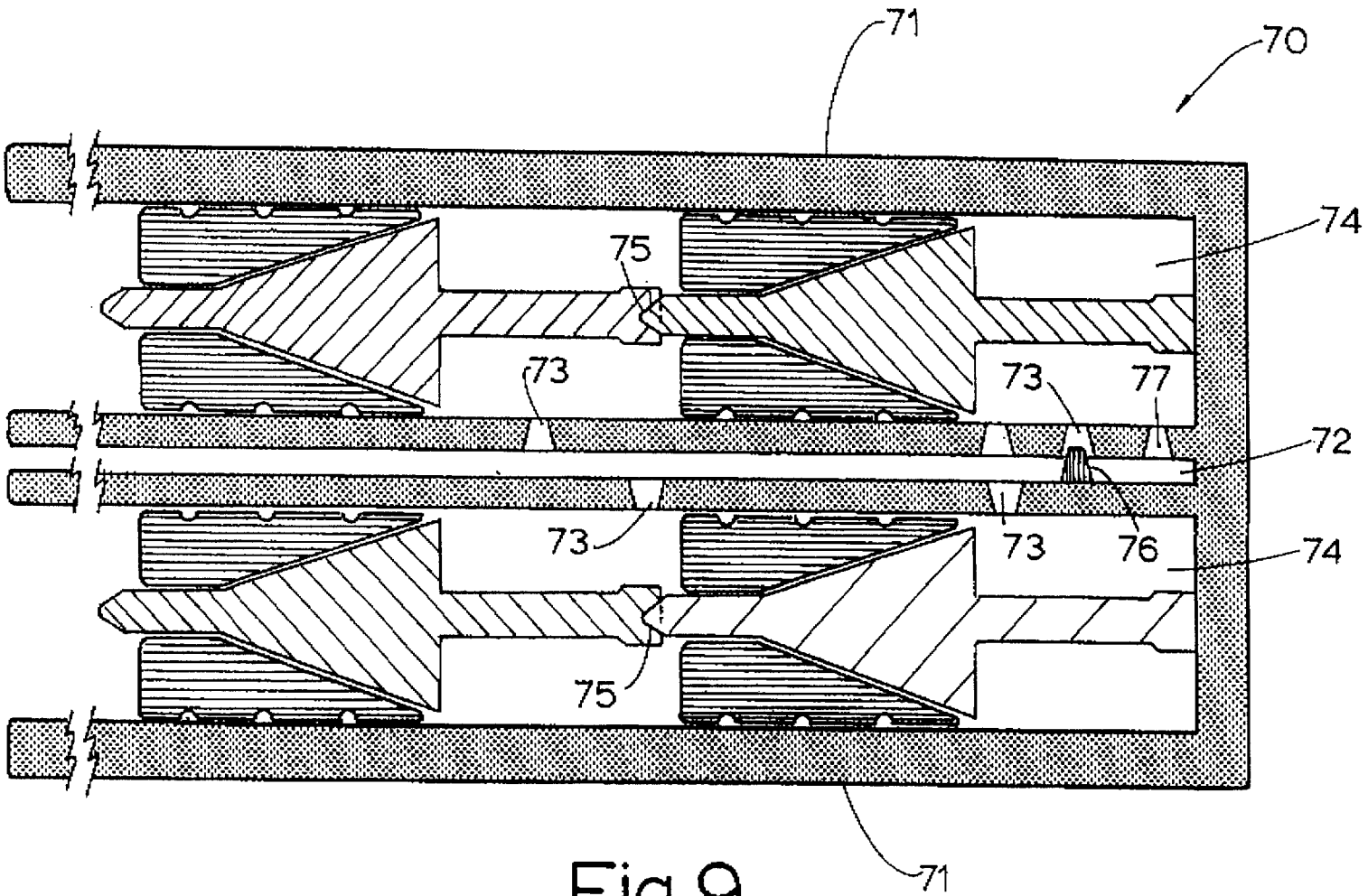
FIG. 9 illustrates a clustered barrel assembly.

In operation of the shotgun illustrated in FIG. 9, when its controls are set to fire single arrays of projectiles 15 at a time, the bolt may be locked for manual cocking, in which case the recoil is negated. However if three or more layers of projectiles 15 are to be fired substantially simultaneously, such as to empty the operative cartridge, the bolt may be unlocked to enable the recoil action to automatically cock the weapon for its next firing, including ejection of the fired cartridge.

The shotgun illustrated in FIG. 2 utilizes a pump action for reloading cartridges in conventional manner. The projectiles 15 are suitably formed with a reverse wedging sealing arrangement as described in corresponding International application filed Jun. 1, 1998 of the inventor or they may utilize a forward wedging arrangement as described in the earlier filed International patent applications of the inventor set out above.

Figure 6A:
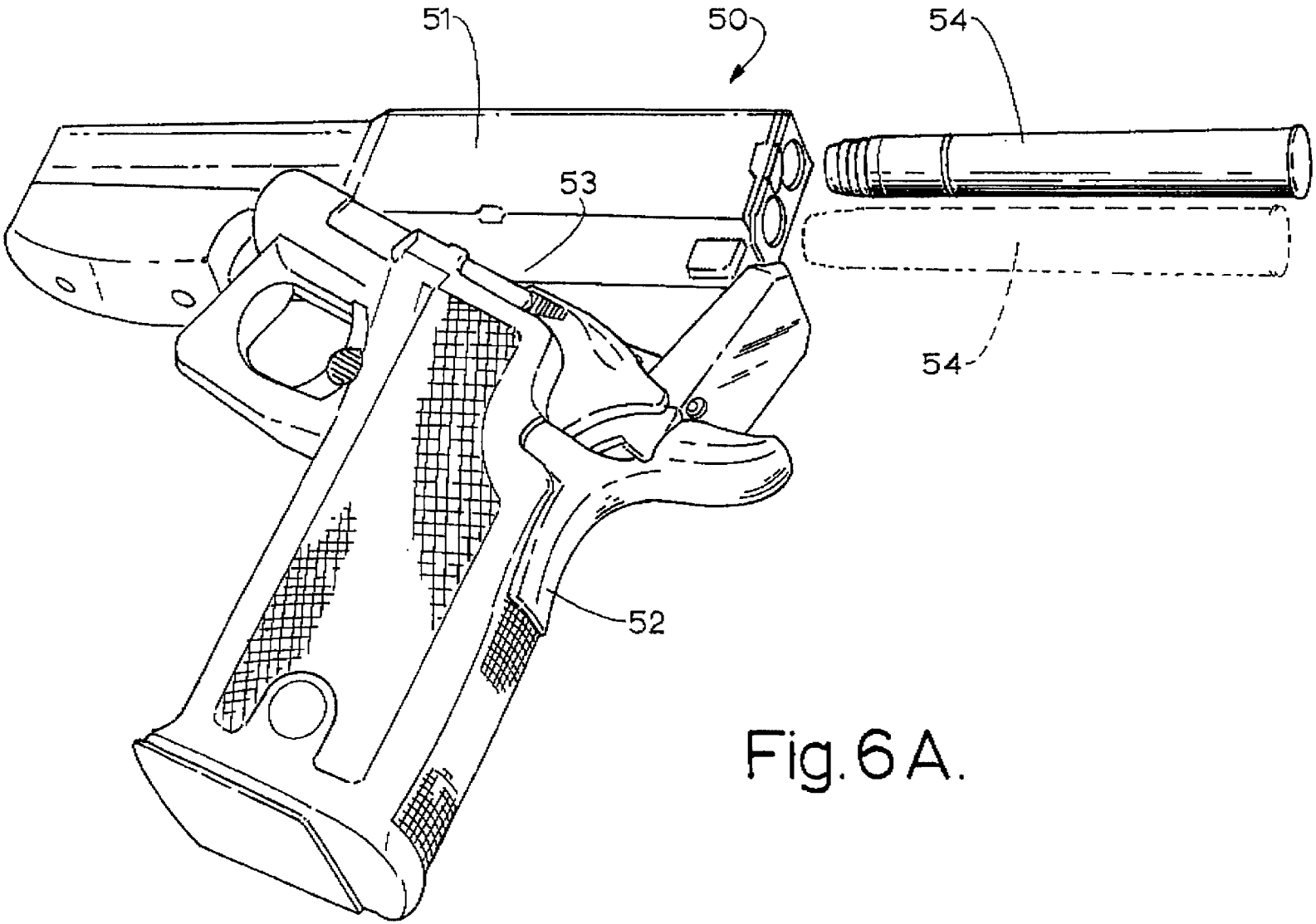
FIGS. 6A and 6B illustrate loading of a further preferred form of handgun.
Figure 6B:
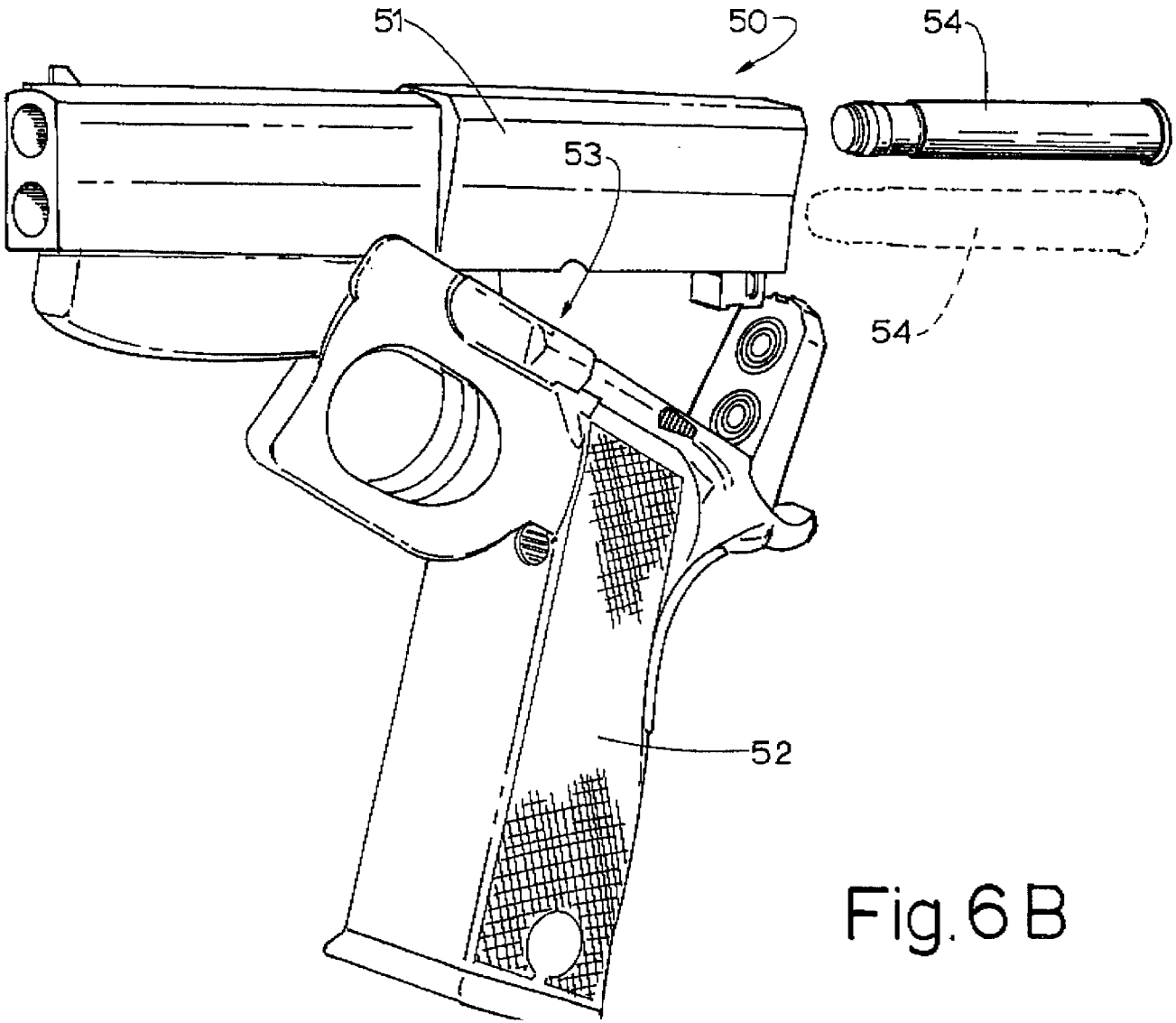
Figure 7:
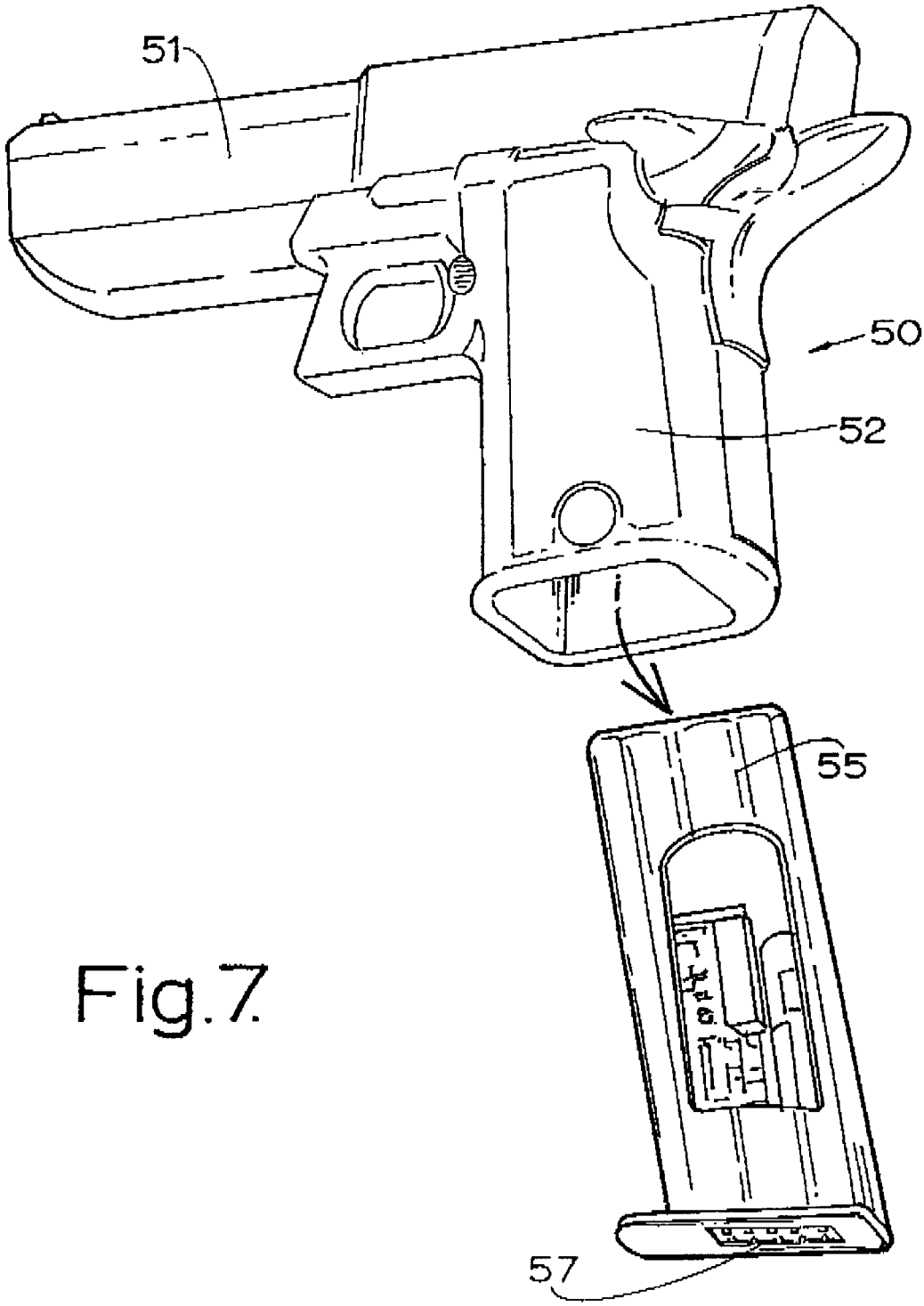
FIG. 7 illustrates the removal of electronic control means for disarming the handgun.

FIGS. 5, 6 and 7 herewith illustrate two pistols according to further aspects of the present invention. The illustrated pistols include a four barrel pistol 40 in which the barrel assembly 41 is removable from the hand grip assembly 42 and a two barrel pistol 50 in which the barrel assembly 51 breaks from the hand grip assembly 52 for reloading.

Referring firstly to the four barrel pistol 40, it will be seen that the barrel assembly 41 which comprises four integrated barrels clustered together and provided with an integral mounting 43 which enables the barrels to be clipped into a cradle assembly 44 which extends above and forwardly of the hand grip 42.

Suitable latching means 45 are provided for maintaining the barrel assembly in its operative position in the cradle assembly 44. The process of removal of the barrel assembly 41 is illustrated sequentially in the drawings. In the first step illustrated in FIG. 5B, the barrel assembly 51 is withdrawn longitudinally from the end cap 47 which contains concentrically arranged electrical contacts 48 which mate with corresponding contacts in the end of the barrel assembly 41 to provide electrical ignition control of the propellant charges therein.

Because the barrel assembly 41 can be readily detached and attached to the cradle assembly 44, this pistol assembly 40 offers the advantage that a user may carry alternate style barrel assemblies for firing different types of projectiles or for rapid reloading should one barrel assembly be emptied or required to be changed in use.

All barrels need not contain the same projectiles. One or more could for example contain a shotgun barrel as described above if desired while the others may contain banks of single projectiles with the same or different propellant charges. Selection switches would be provided to enable a user to fire selected or all barrels. Alternatively they could be mounted about a main passage with bleed passages for simultaneous ignition of all rounds in each respective layer of projectiles.

The barrel assemblies 41 can be of a disposable form or they may be adapted to receive reload cartridges which are inserted into the rear of the respective barrels. Suitable release claws or the like are also supported on the upstanding butt portion 46, which is integral with the hand grip 42, catch the cartridges upon release of the barrel to effect partial withdrawal of spent or partially spent cartridges and thus facilitate their removal for replacement.

If desired the barrel assembly 41 may be supported on a slide and associated with recoil or damping means to minimize the reaction upon firing. This recoil would be particularly useful in an instance where a user required to fire a number of projectiles simultaneously or in quick succession. That is operation of the pistol 40 in a normal manner would provide the normal controllable reaction.

Figure 8:
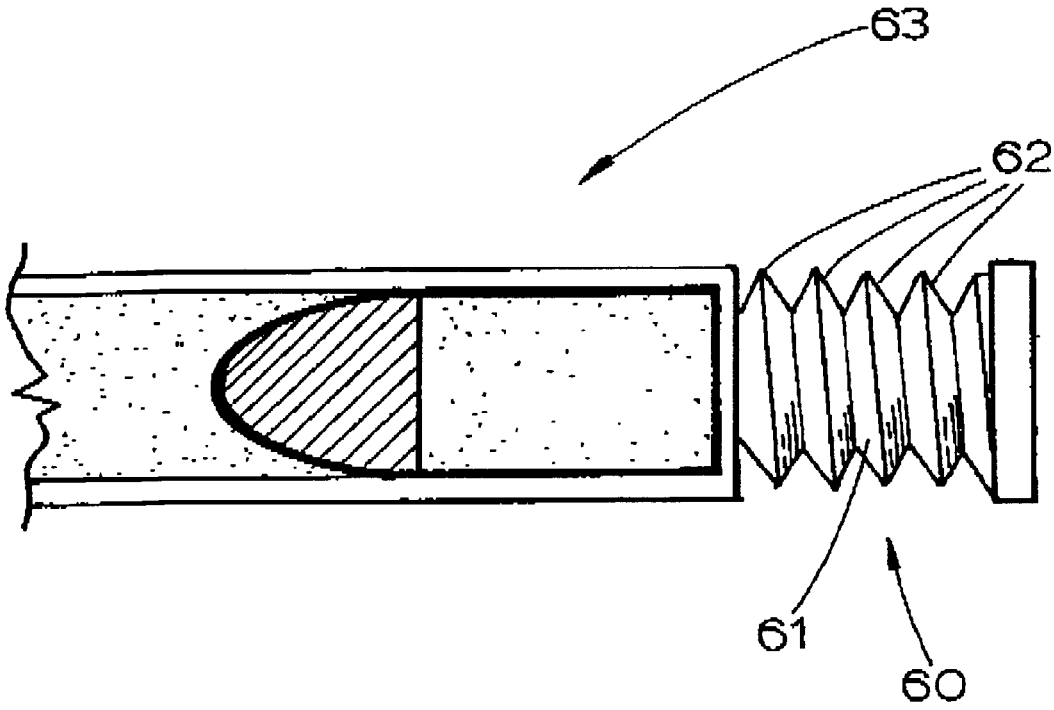
FIG. 8 illustrates one form of cartridge which may be used with the handgun of FIG. 6.

However if the rapid fire facilities available to a user of handguns of the present invention are utilized, the reaction, without damping may render the handgun uncontrollable. Thus a recoil mechanism for handguns programmed with a rapid fire facility, such as is illustrated in FIG. 8, would be most desirable.

The two barrel pistol 50 illustrated in FIG. 7 has the barrel assembly 51 arranged for pivotal movement at the front end of the cradle 53 so that the barrel may be broken for reloading with cartridges. The pistol 50 receives double tap cartridges 54 of the type described in my International Patent Application No. PCT/AU96/00459. This is particularly significant in relation to handguns of the present invention in that the cartridges loaded into each of the barrels may be of different configuration and be operable so that an operator may selectively fire rounds from either barrel such as rounds which have a low lethality or rounds which have a high lethality.

In both pistols 40 and 50 actuation is by means of a trigger which is in effect an electronic switch. This switch could be sensitive to displacement and/or pressure to enable trained personnel to operate the weapon for selective firing of single or multiple rounds and of different types.

The pistol assembly 50 has a control insert 55 which fits into a complementary recess in the pistol grip 52, or grip 42 of pistol 40, and which contains the electronic firing controls, memory for storing recorded data and other required electronics, including diagnostics. The plug-in insert 55 includes a multipin connector at its inner end which engages with a complementary connector when the insert is pushed into the grip 52 to the fully home position. At the base of the insert 55, a further multipin connector 57 is provided to enable the electronics therein to be accessed to enables programming of the electronics and display of stored data for desired functions and results on a screen.

The insert 55 enables a user to secure the pistol against unauthorized use. If desired further security measures may be taken as is described in one of the co-pending International Patent Applications of the inventor.

FIG. 8 illustrates a collapsible stack 60 formed of shock absorbing material 61 and disposed at the rear end of an electronically fired round 63. The stack 60 has sections 62 which collapse progressively upon firing the projectiles in the round. In this manner, recoil damping can be built into a fixed barrel weapon which uses replaceable cartridge assemblies. Furthermore, an operator may use rounds with or without the damping means.

The barrel assembly 70 illustrated in FIG. 9 has barrels 71 clustered about a central bypass passage 72 provided with at least one bleed port 73 associated with the propellant charge 74 of each trailing projectile 75. The ports 73 are provided with plugs as illustrated at 76, which are discharged from the ports 73 when a predetermined pressure is exceeded locally in the barrels 71 so as to bleed the excess pressure to atmosphere through the bypass passage 72.

If desired, more than one port, as illustrated at 77, may be utilized to provide a greater port bleed area for extreme high pressures.

Figure 10:
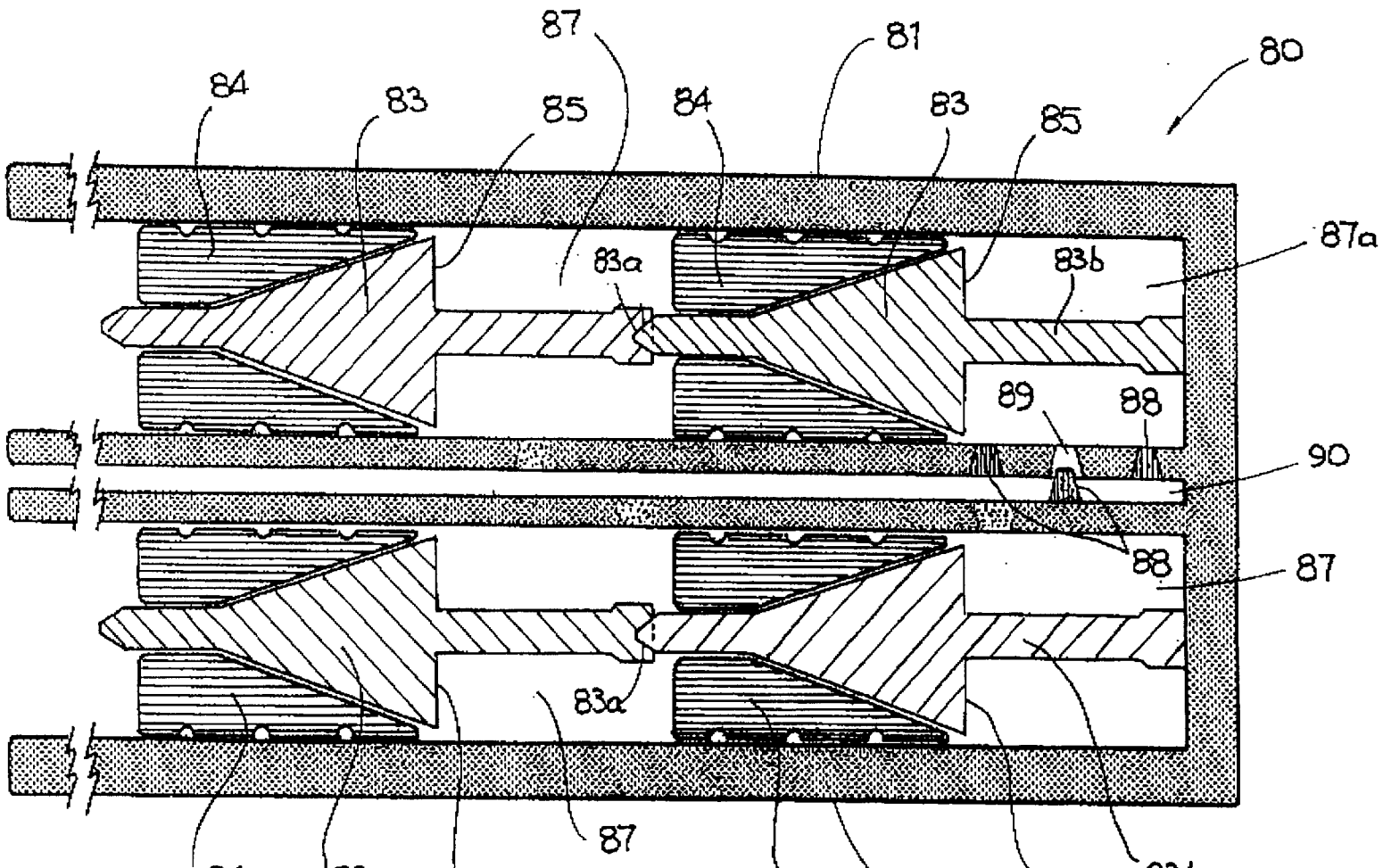
FIG. 10 illustrates further form of clustered barrel assembly.

FIG. 10 shows a barrel assembly 80 having barrels 81 and 82. Each of the barrels 81 and 82 incorporate projectiles 83 and expandable wedges 84. Between the rear face 85 and subsequent projectiles 83 or the barrel breach 86 are propellant spaces 87. The projectiles 83 of the embodiment incorporate a spine member having a nose 83*a* and a tail portion 83*b*. Suitably the nose portion of a trailing projectile engages with a recess in the tail portion of a leading projectile.

The barrel 81 incorporates pressure release plugs 88 whereby if the propellant in propellant space 87*a* detonates and cannot be released up barrel 81, the pressure release plugs 88 may be forcibly ejected from the corresponding ports or apertures 89. The combustion gasses may then be released along the pressure relief tube 90 that is aligned with the barrels 81 and 82 and located therebetween. It will of course be realized that the above has been given only by way of illustrative example of the invention and that all such modifications and variations thereto as would be apparent to persons skilled in the art are deemed to fall within the broad scope and ambit of the invention as is defined in the following claims.

What is claimed is:

1. A barrel assembly for a weapon or firearm, said barrel assembly comprising a plurality of projectiles axially disposed within a barrel and associated with discrete selectively ignitable propellant charges for propelling the projectiles from the barrel wherein said barrel includes at least one pressure relief valve associated with a chamber in which a propellant charge is ignited.

2. The barrel assembly as claimed in claim 1 wherein the pressure relief valve vents into a bypass passage that exhausts in the direction of fire of the barrel assembly.

3. The barrel assembly as claimed in claim 2 wherein the bypass passage is parallel to the barrel.

4. The barrel assembly as claimed in claim 2 wherein the bypass passage coaxially surrounds the barrel.

5. The barrel assembly as claimed in claim 1 wherein the bypass passage extends for the length of the barrel.

6. The barrel assembly as claimed in claim 1 wherein the pressure relief valve is in the form of a plug or bung fixed into the barrel such that said plug or bung is ejected from the aperture when the barrel pressure reaches a selected limit.

7. The barrel assembly as claimed in claim 1 wherein the pressure relief valve is in the form of a rupturable section of the barrel that is formed from a material that is selected to fail when the barrel pressure reaches a selected limit.

8. The barrel assembly as claimed in either claim 6 or claim 7 further comprising a shielded cover for retaining any ejected component from the pressure relief valve.

9. The barrel assembly as claimed in claim 8 wherein the shielded cover may be in the form of an armour-plated cover, a pneumatic chamber, or a damped receptacle such as an oil filled reservoir.

10. The barrel assembly as claimed in claim 1 wherein pressure relief valves are positioned along the barrel in spaced relation with one another.

11. The barrel assembly as claimed in claim 10 wherein a pressure relief valve is positioned in the barrel adjacent each chamber in which a propellant charge is ignited.

12. The barrel assembly as claimed in claim 10 wherein a pressure relief valve is positioned along the barrel and spaced so as to associate with every second, third or more propellant charges.

13. A weapon incorporating a barrel assembly according to claim 1.

14. A handgun assembly comprising:

a barrel assembly including a cluster of barrels, each barrel including:

a longitudinal arrangement of aerodynamically shaped, directional projectiles and interposed propellant charges whereby the barrel assembly has longitudinal arrays or layers of projectiles and interposed propellant charges, and at least one pressure relief valve associated with a chamber wherein a propellant charge is detonated; and ignition means for simultaneously igniting the propellant charges in a respective layer of propellant charges.

15. The handgun assembly as claimed in claim 14 wherein the barrels are clustered about one or more bypass passages extending substantially parallel to the barrels and communicating therewith through said at least one pressure relief valve with longitudinally spaced arrays of transverse bleed passages whereby, in the event of an accidental ignition of a primer in a trailing round, the valve will open to enable the ignited propellant charges to bleed to atmosphere through a bypass passage.

16. The handgun assembly as claimed in claim 14 wherein individual barrels are provided with respective pressure relief valves enabling each propellant chamber to discharge to a bypass passage in the event of a hang fire or similar accidental ignition of a trailing propellant charge.

17. The handgun assembly as claimed in either claim 15 or claim 16 wherein pressure valves comprise a plugged port in which the plug will be dislodged at a preselected pressure above the normal operating pressures within the barrels.

18. The handgun assembly as claimed in claim 14 wherein said handgun is a shotgun having a large number of small bore barrels clustered about a central passage.

19. A handgun assembly comprising:

a cluster of small bore barrels of the type described, each barrel including:

a longitudinal arrangement of aerodynamically shaped, directional projectiles and interposed propellant charges whereby the barrel assembly has longitudinal arrays or layers of projectiles and interposed propellant charges arranged in longitudinally spaced relationship in their respective barrels, and at least one pressure relief valve associated with a chamber wherein a propellant charge is ignited; and ignition means for simultaneously igniting the propellant charges in a respective layer of propellant charges.

20. The handgun assembly as claimed in either claim 14 or claim 19 wherein the projectiles in each barrel are configured for sealing engagement between. projectiles and barrel being such as to prevent rearward travel of the ignited propellant charge to trailing propellant charges.

* * * * *